US006301718B1

(12) United States Patent
Rigal

(10) Patent No.: US 6,301,718 B1
(45) Date of Patent: Oct. 16, 2001

(54) PROTECTIVE HELMET

(75) Inventor: Jean-Pierre Rigal, La Balme de Sillingy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/708,076

(22) Filed: Nov. 8, 2000

(30) Foreign Application Priority Data

Nov. 9, 1999 (FR) ..... 99 14684

(51) Int. Cl.[7] ..... A42B 3/00; A63B 71/10
(52) U.S. Cl. ..... 2/411; 2/425
(58) Field of Search ..... 2/411, 410, 425, 2/422

(56) References Cited

U.S. PATENT DOCUMENTS 3,866,909 * 2/1975 DeSantis .
4,068,613 1/1978 Rubey ..... 116/114 AH
4,663,785 * 5/1987 Comparetto .
4,763,275 8/1988 Carlin ..... 364/508
5,343,569 * 9/1994 Asare et al. .
5,546,609 * 8/1996 Rush, III .
5,621,922 * 4/1997 Rush, III .
6,065,158 * 5/2000 Rush, III .

FOREIGN PATENT DOCUMENTS 3426268 1/1986 (DE) .
2350607 12/1977 (FR) .
2566632-A1 * 1/1986 (FR) .

* cited by examiner

*Primary Examiner*—Rodney M. Lindsey
(74) *Attorney, Agent, or Firm*—Greenblum & Bernstein P.L.C.

(57) ABSTRACT

A protective helmet that includes a cap, a protective padding, possibly a comfort padding, and a retaining system. According to the invention, the cap has a visual impact indicator whose state changes when the cap is subject to an impact exceeding a predetermined threshold. For example, the indicator is formed by a capillary tube sealed at both ends enclosing a drop of colored liquid trapped between two gas bubbles. The invention applies to any type of helmet, for the practice of a sport, for motorcycling, for professional use, or as a safety helmet.

11 Claims, 2 Drawing Sheets

PROTECTIVE HELMET

BACKGROUND OF THE INVENTION

1. Field of the Invention

The present invention relates to a protective helmet.

2. Description of Background and Relevant Information

In a known fashion, a helmet generally includes an outer cap, a protective padding, a comfort padding, and a retaining system.

Essentially, a helmet is provided to protect the user's head. Under these conditions, the cap of the helmet can be subject to strikes or impacts. The helmet can also receive impacts when it is being handled.

Sometimes, the helmet can be used successively by various users. This is the case, for example, when the helmet is lent or rented with equipment to practice a given sport.

Under such a circumstance, it is difficult for the user or renter to be aware of the treatment to which the helmet has been subject previously.

In particular, the helmet may have received a previous substantial impact that renders it inadequate for another use as a protective helmet.

As a result, existing helmets are not completely reliable.

SUMMARY OF THE INVENTION

An object of the present invention is to increase the reliability of the currently known helmets.

To this end, the helmet according to the invention has a protective cap. The cap is equipped, at least locally, with at least one visual impact indicator.

The expression "visual impact indicator" is intended to refer to an element whose state or color changes subsequent to an impact exceeding a predetermined threshold. By noticing this change of state or color, the owner, renter or user is warned that the subject helmet can no longer be used as a protective helmet.

BRIEF DESCRIPTION OF DRAWINGS

The invention will be better understood from the description that follows, with reference to the annexed drawings that are an integral part thereof, and in which.

DETAILED DESCRIPTION OF THE INVENTION

Figure 1:
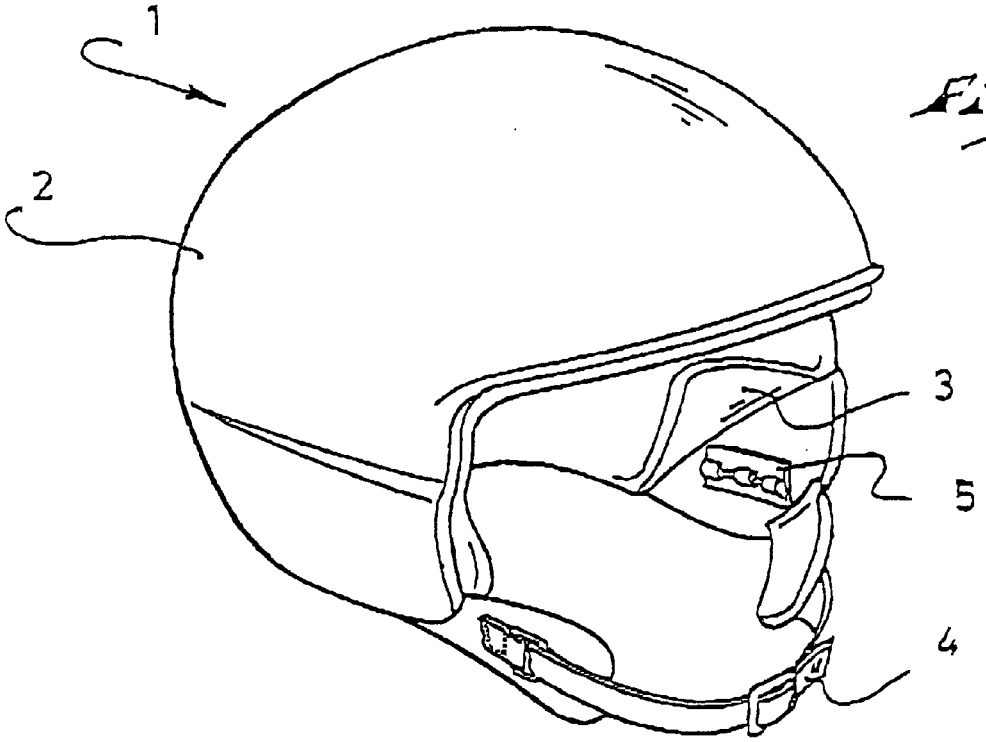
FIG. 1 shows a side view of a helmet according to a non-limiting embodiment of the invention.

FIG. 1 shows a helmet 1 in a perspective view. The helmet is of any appropriate type. In the embodiment shown, the helmet is provided, for example, as a protective helmet for the practice of a given sport.

Conventionally, the helmet includes a cap 2 made of plastic, for example. The cap encloses a protective padding, such as a comfort padding. These pads are of a known type and are not shown in the figure. The helmet 1 further has a retaining system which is shown in the form of a chin strap 4.

According to the invention, the cap of the helmet carries at least one visual impact indicator. The state of such an indicator changes following an impact on the cap that would exceed a predetermined threshold. The change of state can translate, for example, into a change in the color of the indicator.

The impact indicator can be positioned outside or within the cap. It can be integrated within the cap or affixedly attached to the cap, for example, by gluing, by way of an adhesive, or by an irreversible mechanical attachment member, for example, clamps extending through the cap, rivets, etc.

In the embodiment shown, the impact indicator is an attached element adhered within the helmet, in one of the zones that covers the cheek, beneath the comfort covering 3. It could also be located at the bottom of the cap. The impact indicator 5 here is consistent with what is described in French Patent No. 2 350 607.

Figure 2:
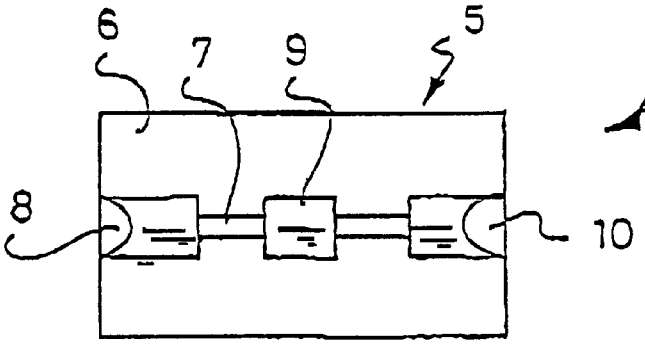
FIG. 2 shows an impact indicator.
Figure 3:
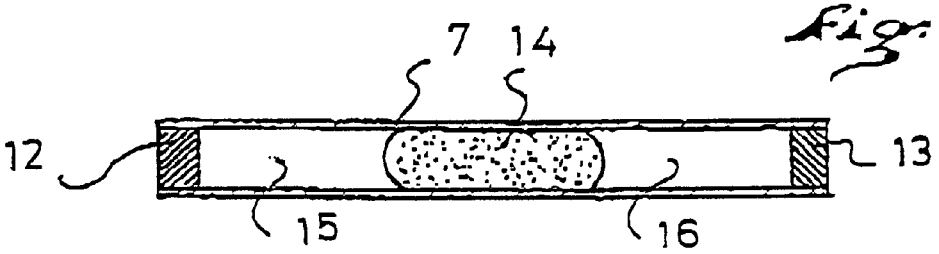
FIG. 3 shows the functioning mode of the impact indicator of FIG. 2.

Such an indicator is shown in more detail in FIGS. 2 and 3. It includes a base 6 that is provided to be assembled affixedly to the cap of the helmet, and a transparent capillary tube 7 retained on the base by stops 8, 9, and 10.

According to an embodiment of the impact indicator, the tube 7 is internally fitted with a hydrophobic substance, it is scaled at its two ends by plugs 12 and 13. It contains, in the area of the central stop 9, a quantity, such as a drop, of a colored liquid 14 that is trapped between two gas bubbles 15, 16, such as air bubbles. The liquid that forms the drop 14, for example, is an aqueous solution of an antifreeze such as ethylene glycol, and of a water soluble, for example redcolored, dye. The gas is air, for example.

At rest, and in the absence of a violent impact, the drop 14 is kept between the two air bubbles 15 and 16. The hydrophobic covering at the surface of the tube prevents the liquid from wetting the wall of the capillary tube 7.

When viewed from the outside, the drop is hidden by the stop 9.

In the case of a violent impact, the surface tension at the surface of the liquid breaks. The colored liquid spreads inside the entire volume of the tube, in particular, in the zones located between the stops. The color of these zones changes, which indicates that the cap has been subject to an impact exceeding a predetermined threshold and that, as a result, the helmet involved can no longer be used as a protective helmet.

The impact threshold is in fact determined by the type of materials used for the tube and the liquid, as well as by the cross-section of the tube.

The construction of the impact indicator is not limiting, and other constructions are also suitable, these other constructions being based on alternative embodiments of the indicator described, or on another principle of impact detection.

Figure 4:
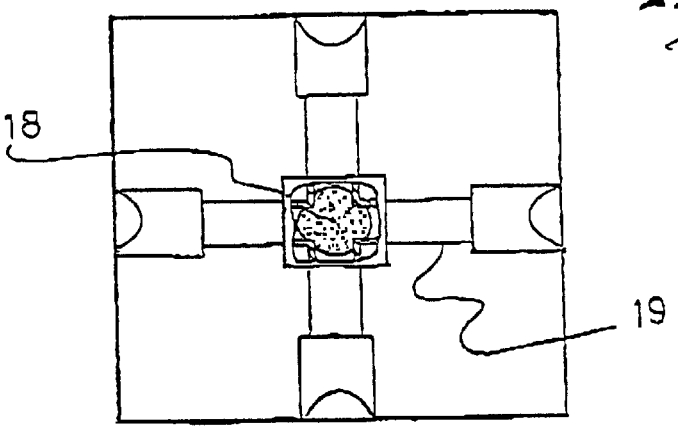
FIG. 4 relates to an alternative embodiment of the impact indicator.

FIG. 4 relates to an alternative embodiment of the impact sensor. Rather than being confined in a rectilinear tube, the drop 18 is enclosed in a complex tube 19 that has four crosswise arms. At rest, and in the absence of impact, the drop 18 is located at the intersection of the arms. It is kept in position by four gas bubbles, each located between the drop and the end of the arm. The functioning principle is the same as for the previous tube. The sensitivity of the sensor to multidirectional impacts is improved here.

Figure 6:
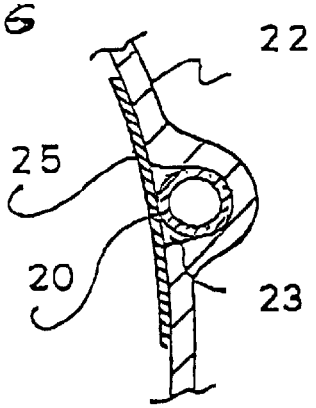
FIGS. 5 and 6 show another embodiment of the invention where the impact indicator is integrated in the cap of the helmet.
Figure 5:
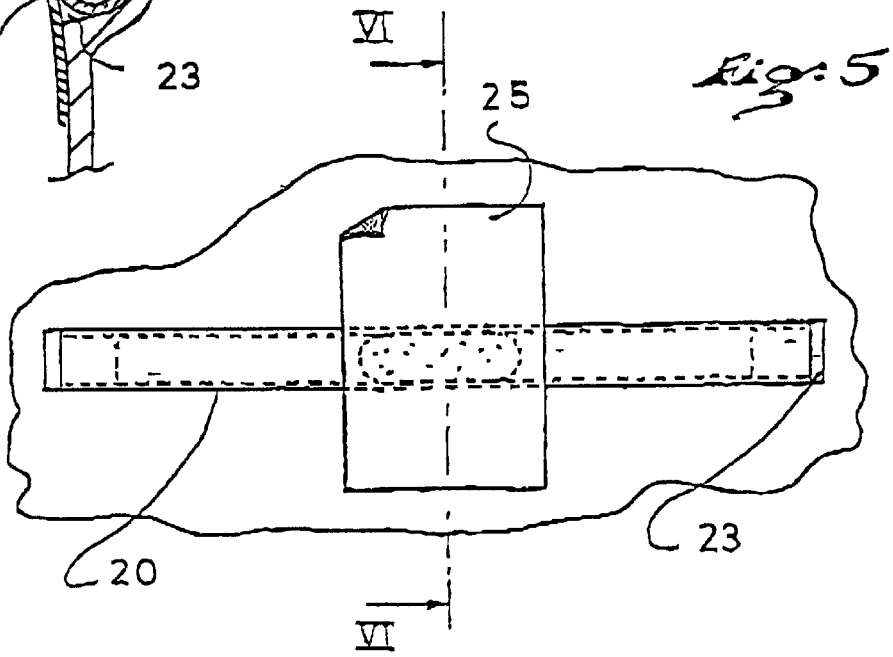

FIGS. 5 and 6 show an alternative embodiment of the invention. According to this variation, the tube 20 that contains the liquid drop and the gas bubbles is integrated in the structure of the cap.

Thus, the cap 22 of the helmet locally has a housing 23 in which the tube 20 is nested. The housing 23 is formed by a local deformation of the cap 22.

The tube 20 is kept in place by an attached tongue 25 that covers the central zone of the tube where the liquid drop is located. Other construction modes are also suitable.

The present description is provided for guidance only, and other embodiments of the invention could be adopted without leaving the scope thereof.

In particular, the invention applies not only to the helmet that has been described, but it applies to any type of protective helmet, for the practice of a sport, for riding a motorcycle, for professional protective helmets, for example, safety helmets, or the like.

Furthermore, it is possible to equip the cap wit two indicators placed in various positions of the cap.

Other methods for mounting the indicator on the cap could also be adopted.

The instant application is based upon French Patent Application No. 99 14684, filed Nov. 9, 1999, the disclosure of which is hereby incorporated by reference thereto in its entirety, and the priority of which is hereby claimed under 35 U.S.C. §119.

What is claimed is:

1. A protective helmet comprising:

a protective cap; and at least one visual impact indicator mounted to the protective cap, wherein the at least one visual impact indicator includes a colored liquid.

2. A helmet according to claim 1, wherein said visual impact indicator is of a color-changing type.

3. A helmet according to claim 2, wherein said visual impact indicator includes a capillary tube, said capillary tube comprising opposite sealed ends and enclosing a drop of colored liquid trapped between two gas bubbles.

4. A helmet according to claim 1, wherein said visual impact indicator is attached to a surface of said cap.

5. A helmet according to claim 1, wherein said visual impact indicator is visible within said cap.

6. A helmet according to claim 5, wherein said visual impact indicator is attached to said cap beneath a comfort covering layer.

7. A helmet according to claim 1, wherein said visual impact indicator is nested in said cap.

8. A helmet according to claim 7, wherein said indicator includes a tube, wherein said tube is maintained in said cap, in a housing of said cap made by a local deformation of said cap.

9. A protective helmet comprising:

a protective cap having an inner surface and a cavity which opens to the inner surface;

at least one visual impact indicator arranged in the cavity, wherein the at least one visual impact indicator includes a colored liquid.

10. A protective helmet comprising:

a protective cap having an integral housing formed thereon;

at least one visual impact indicator arranged in the integral housing, wherein the at least one visual impact indicator includes a colored liquid.

11. A protective helmet comprising:

a protective cap having one of a cavity which is one of an integral housing and a local deformation;

the cavity being open to an inner surface of the protective cap;

at least one visual impact indicator arranged in the cavity, wherein the at least one visual impact indicator includes a colored liquid.

* * * * *